US008084966B2

(12) United States Patent
Dewert

(10) Patent No.: US 8,084,966 B2
(45) Date of Patent: Dec. 27, 2011

(54) ELECTROMOTIVE FURNITURE DRIVE FOR DISPLACING PARTS OF AN ITEM OF FURNITURE IN RELATION TO ONE ANOTHER

(75) Inventor: Eckhart Dewert, Zürich (CH)

(73) Assignee: Linak A/S, Nordborg (DK)

( * ) Notice: Subject to any disclaimer, the term of this patent is extended or adjusted under 35 U.S.C. 154(b) by 1332 days.

(21) Appl. No.: 10/496,146

(22) PCT Filed: Nov. 21, 2002

(86) PCT No.: PCT/EP02/13036

§ 371 (c)(1),
(2), (4) Date: May 25, 2004

(87) PCT Pub. No.: WO03/045195

PCT Pub. Date: Jun. 5, 2003

(65) Prior Publication Data

US 2004/0262587 A1 Dec. 30, 2004

(30) Foreign Application Priority Data

Nov. 26, 2001 (DE) ..... 101 57 650

(51) Int. Cl.
*B65H 59/38* (2006.01)

(52) U.S. Cl. ..... 318/7; 318/467; 318/466; 318/432; 318/560; 297/285

(58) Field of Classification Search ..... 318/7, 466, 318/467, 432, 560; 297/285; 5/611
See application file for complete search history.

(56) References Cited

U.S. PATENT DOCUMENTS 4,435,862 A * 3/1984 King et al. ..... 5/611
5,063,623 A 11/1991 Bathrick et al.
5,075,911 A 12/1991 Dewert
5,205,004 A * 4/1993 Hayes et al. ..... 5/611
5,224,429 A * 7/1993 Borgman et al. ..... 108/147
5,497,676 A * 3/1996 Barnard ..... 74/501.5 R (Continued)

FOREIGN PATENT DOCUMENTS

DE 3842078 7/1989

(Continued)

OTHER PUBLICATIONS

English Abstract of DE 20302147, Apr. 2003.

(Continued)

*Primary Examiner* — Walter Benson
*Assistant Examiner* — David S Luo
(74) *Attorney, Agent, or Firm* — Dykema Gossett PLLC

(57) ABSTRACT

An electromotive furniture drive (2) for displacing parts of an item of furniture in relation to one another comprises a base body (16) on which a first drive unit (4) and a second drive unit (6) are held. When the furniture drive (2) is mounted, each drive unit (4, 6) is actively connected to a part of the item of furniture to be displaced. According to the invention, the drive units (4, 6) are each accommodated in a separate housing (8 or 10), whereby the base body (16) is provided in the form of a brace and connects the housings (8, 10) of the drive units (4, 6) to one another. The inventive model significantly simplifies the production of furniture drives whereby rendering it more economical.

18 Claims, 5 Drawing Sheets

U.S. PATENT DOCUMENTS

| | | | | |
|---|---|---|---|---|
| 5,675,849 | A | 10/1997 | Koch | |
| 5,927,144 | A * | 7/1999 | Koch | 74/89.36 |
| 6,158,295 | A * | 12/2000 | Nielsen | 74/89.38 |
| 6,246,191 | B1 * | 6/2001 | Bokamper et al. | 318/12 |
| 6,269,707 | B1 * | 8/2001 | Koch | 74/89.23 |
| 6,300,732 | B1 | 10/2001 | Brambilla | |
| 6,377,010 | B1 * | 4/2002 | Roither | 318/560 |
| 6,539,566 | B1 * | 4/2003 | Hayes | 5/618 |
| 6,687,932 | B1 * | 2/2004 | Bangert et al. | 5/617 |
| 6,763,536 | B2 | 7/2004 | Dewert | |
| 6,841,953 | B2 * | 1/2005 | Bastholm | 318/7 |
| 6,879,073 | B2 | 4/2005 | Roither et al. | |
| 2002/0036421 | A1 | 3/2002 | Bangert | |
| 2004/0169408 | A1 | 9/2004 | Dewert | |

FOREIGN PATENT DOCUMENTS

| | | |
|---|---|---|
| DE | 10017978 | 7/2001 |
| DE | 10017979 | 7/2001 |
| DE | 10031737 | 3/2002 |
| DE | 20302147 | 5/2003 |
| WO | 0200065 | 1/2002 |
| WO | 2004032687 | 4/2004 |

OTHER PUBLICATIONS

English Abstract of DE 3842078, Jul. 1989.
English Abstract of DE 10017978, Jul. 2001.
English Abstract of DE 10017979, Jul. 2001.
English Abstract of DE 10031737, Mar. 2002.

* cited by examiner

ELECTROMOTIVE FURNITURE DRIVE FOR DISPLACING PARTS OF AN ITEM OF FURNITURE IN RELATION TO ONE ANOTHER

BACKGROUND OF THE INVENTION

1.Field of the Invention

The invention refers to an electromotive furniture actuator for adjusting portions of a piece of furniture relative to each other.

2.The Prior Art

Such furniture actuators are generally known and are, for example, used for adjusting portions of slatted grids or the like.

From EP 0 372 032 B1 a furniture actuator of said type and formed as a double actuator is known for adjusting portions of a piece of furniture relative to each other, which actuator has a base body, on which are mounted a first actuator unit and a second actuator unit, each actuator unit being functionally connected to a portion of the piece of furniture to be adjusted in the assembled position of the furniture actuator. In the known furniture actuator an actuator unit serves to adjust a head support portion of a slatted grid, while the other actuator unit serves to adjust a foot support portion of a slatted grid. In the known furniture actuator, the base body is formed by a trough-shaped housing which is formed by an injection-moulded piece. The elements of the actuator units, namely an electromotor, a gear and a spindle drive, respectively, are inserted in the housing and are held in their fixed position by detention means and holding webs formed onto the housing.

A disadvantage in the known furniture actuator is that it is relatively complex and thus costly regarding its manufacture.

Similar furniture actuators are also known from DE 38 42 078 C2, EP 0 583 660 B1, DE 100 17 978 A1, DE 100 17 979 A1 and WO 01/76422 A1.

The invention is based on the object to provide a furniture actuator which does not have the disadvantage of the known furniture actuators and whose manufacture is thus simpler and consequently made less costly.

SUMMARY OF THE INVENTION

The teaching according to the invention breaks with the idea of receiving the actuator units in a common housing in the case of a furniture actuator formed as a double actuator. Quite in contrast, it is based on the idea of forming the double actuator from relatively simple and thus cost-efficient standard components. According to the invention, the actuator units are received in a separate housing, each, the base body being formed strut-shaped and connecting the housings of the actuator units with each other.

In this manner, the furniture actuator according to the invention can be manufactured particularly simply and thus cost-efficiently, because it is no longer necessary to produce a housing for receiving the actuator units as an injection-moulding piece of large volume. The much smaller separate housings for the actuator units can be manufactured in a much more simple and thus cost-efficient way. Moreover, the strut-shape formed base body can be manufactured in a particularly cost-efficient manner. For example, it can be formed by flat (bar) iron or the like.

As a result, the furniture actuator according to the invention can be produced in a simpler and therefore more cost-efficient way when compared with the known furniture actuator. Moreover, its structure is particularly robust.

A specific advantage of the teaching according to the invention exists in that the invention provides an option for manufacturing different furniture actuators in accordance with a modular principle.

For example, if furniture actuators having a different distance between the actuator units are to be produced, for example for matching with different spacings between axes of pivoting axles of slat grids being adjustable by means of the actuator units, it is not required, in accordance with the invention, to produce a separate housing for each axes spacing. More or less, it is simply necessary to adapt the length of the base body to the desired axes spacing, e.g. by cutting flat iron available by the meter according to the necessary distance. In this manner, the production of a plurality of differing furniture actuators is essentially rationalized and therefore essentially more cost-efficient, so that the costs for producing each actuator are reduced substantially.

Beyond this, stock-keeping is substantially simplified for the producer of furniture actuators, because it is only necessary to hold available the actuator units as well as material appropriate for the base body, for example flat (bar) iron as meter ware.

If the furniture actuator is arranged as a double or twin actuator, the same component each may be used for both actuator units.

The furniture actuator according to the invention can be applied in many different ways and is particularly appropriate for adjusting portions of pieces of furniture for sitting and/or lying on.

In each case, the strut-shaped base body and the actuator units form essential elements of the invention.

An individual actuator constructed according to the modular concept of the invention includes a strut-shaped base body in one end of which a housing of an actuator unit is supported, which is functionally connected with a portion of the furniture to be adjusted in the assembled position of the furniture actuator, the base body's remote end relative to the housing being supported on one part of the piece of furniture in the assembly position of the furniture actuator. Following the teaching of the invention, single actuators or double actuators may thus be manufactured according to the respective requirements using the same components. However, it is also possible to manufacture furniture actuators with more than two actuator units.

Principally, the actuator unit or the actuator units may be attached to the base body, e.g. the housings of the actuator units can be welded to the base body or adhered thereto. However, an extremely advantageous embodiment of the teaching according to the invention provides that the actuator unit/units is/are arranged detachably and in a manner to be locked to the base body by locking means. In this embodiment, the manufacturing of the furniture actuator according to the invention is further simplified and thus designed in an even more cost-efficient manner. The detachable connection between the base body and the actuator unit or actuator units moreover simplifies dismantlement and, if necessary, a re-application of the components of the furniture actuator according to the invention.

Basically, the actuator units can be arranged stationarily on the base body. However, according to another particularly advantageous embodiment of the teaching of the invention, it is provided that the actuator units can be adjusted relative to each other and can be arrested in their respective adjustment position by locking means. In this embodiment, the flexibility in manufacture and use of a furniture actuator according to the invention is further increased.

Expediently, the locking means for arresting the actuator unit or actuator units on the base body are detention means. Such detention means can be realized in a particularly simple and thus cost-efficient manner.

Principally, the locking means may be arranged on the outside of the housing of each actuator unit. An advantageous embodiment provides that the locking means are arranged in the housing of each actuator unit. In this embodiment, the locking means are protected from undesired activation. The housings of the actuator units may each have a removable cover, after the taking off of which the locking means may be detached.

According to the respective requirements, the base body can extend essentially linearly or may be formed as an angle or U-shaped, as has been provided by embodiments. For example, in the case of a double actuator, by a linear extension of base bodies of differing length it is possible to select the distance of the actuator units according to the respective requirements. When the base body is formed as an angle or in a U-shape the actuator units of a double actuator may be assembled in almost random position relative to each other.

Basically, it suffices if the base body is formed to be essentially rigid. In this manner, the base body, and thus the furniture actuator, is robust regarding its structure, so that stress occurring during the operation of the furniture actuator, for example when the slatted grid is adjusted under load, will not lead to considerable deformation of the base body.

The base body may, however, also comprise at least two portions which can be locked relatively to each other and in their respective adjustment position. In this manner, the flexibility in using the furniture actuator according to the invention can be further increased.

It is possible to select the shape, size and material of the base body within wide limits.

According to the invention, a strut-shaped base body means a base body which connects e.g. the housings of the actuator units of a double actuator with each other without having to be shaped as a housing as has to be done in the case of furniture actuators according to prior art.

An embodiment which can be manufactured in a cost-efficient manner and is simultaneously robust provides for the base body having at least two struts or braces which are parallel to and spaced from each other. In this manner, distortions of the base body occurring under load of the furniture actuator are avoided to the utmost extent.

The braces may be manufactured in randomly appropriate manner and may exist of randomly appropriate material. Advantageously, the braces are formed by flat iron, or the like. This embodiment is particularly cost-efficient and, at the same time, robust.

Principally, the base body can be attached on the outer sides of the housing of each actuator unit. An advantageous embodiment, however, provides for the housing of each actuator unit to have at least one recess through which the base body extends into the housing. In such embodiment, the base body is held in the housing within the actuator unit or in the housings of the actuator units, so that the stability of the furniture actuator is improved even further.

The actuating principle according to which an actuator unit adjusts a portion of a piece of furniture to be adjusted may be selected within wide limits. If the furniture actuator is used to adjust parts of slatted frames, in which the portions to be adjusted are in connection with a pivot shaft, on which a pivot lever is attached in a rotatably fixed manner, it is expedient if at least one actuator unit has a linearly movable actuating element for pivoting a pivot lever which, in assembly position of the furniture actuator is in functional connection with a portion of the piece of furniture to be adjusted.

In the case of the aforementioned embodiment, it is advantageous if the linearly movable actuating element is in actuating connection with a linearly movable actuating element or is formed by the actuating element. In this embodiment, the actuating element can be actuated by means of a linear actuator.

An advantageous further embodiment of the aforementioned embodiment provides for the linearly movable actuating element to be a spindle nut held in a rotatably secured and axially movable manner on an adjustment spindle which can be driven to rotate. Such spindle drives are available as simple and thus cost-efficient standard components.

When kinematically reversing the aforementioned embodiment, the linearly movable actuating element may, however, also be an adjustment spindle which is movable in its axial direction and mounted secured against rotation, on which spindle a locally fixed spindle nut which can be driven to rotate is mounted. If the furniture actuator according to the invention is used for adjusting parts of a slatted frame, it is expedient if the housing of at least one actuator unit has a recess which, in the mounting position of the furniture actuator, is engaged by a shaft of the piece of furniture carrying the pivot lever, in a manner that the pivot lever is in functional connection with the linearly movable actuating element. In this embodiment, the shaft of the piece of furniture carrying the pivot lever is mounted in the recess.

In the following, the invention will be explained in greater detail with reference to the accompanying drawings in which embodiments of the furniture actuator according to the invention are represented.

DETAILED DESCRIPTION OF THE PREFERRED EMBODIMENTS

Figure 1:
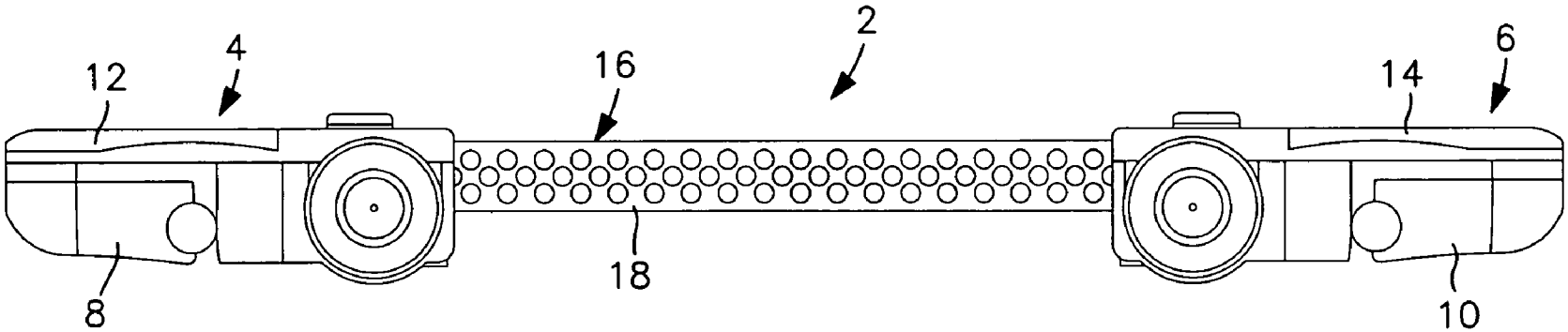
FIG. 1 shows a first embodiment of a furniture actuator according to the invention by way of a schematic side view.

Same or corresponding components of the figures of the drawings are provided with the same reference numerals.

FIG. 1 represents a first embodiment of a furniture actuator 2 according to the invention which is formed as a double or twin actuator and has two actuator units 4, 6. According to the invention, the actuator units 4, 6 are received in a separate housing 8, 10, respectively, the housing 8 being closed by a cover 12 and the housing 10 being closed by a cover 14. The furniture actuator 2 furthermore has, according to the invention, base body 16 formed in a strut-shape, which body connects with each other the housings 8, 10 of the actuator units in a manner explained in detail below by way of FIG. 1. In this embodiment the base body 16 consists of two braces (struts) which are parallel to each other, each formed by flat (bar) iron and of which only one brace 18 can be recognized from FIG. 1.

Figure 2:
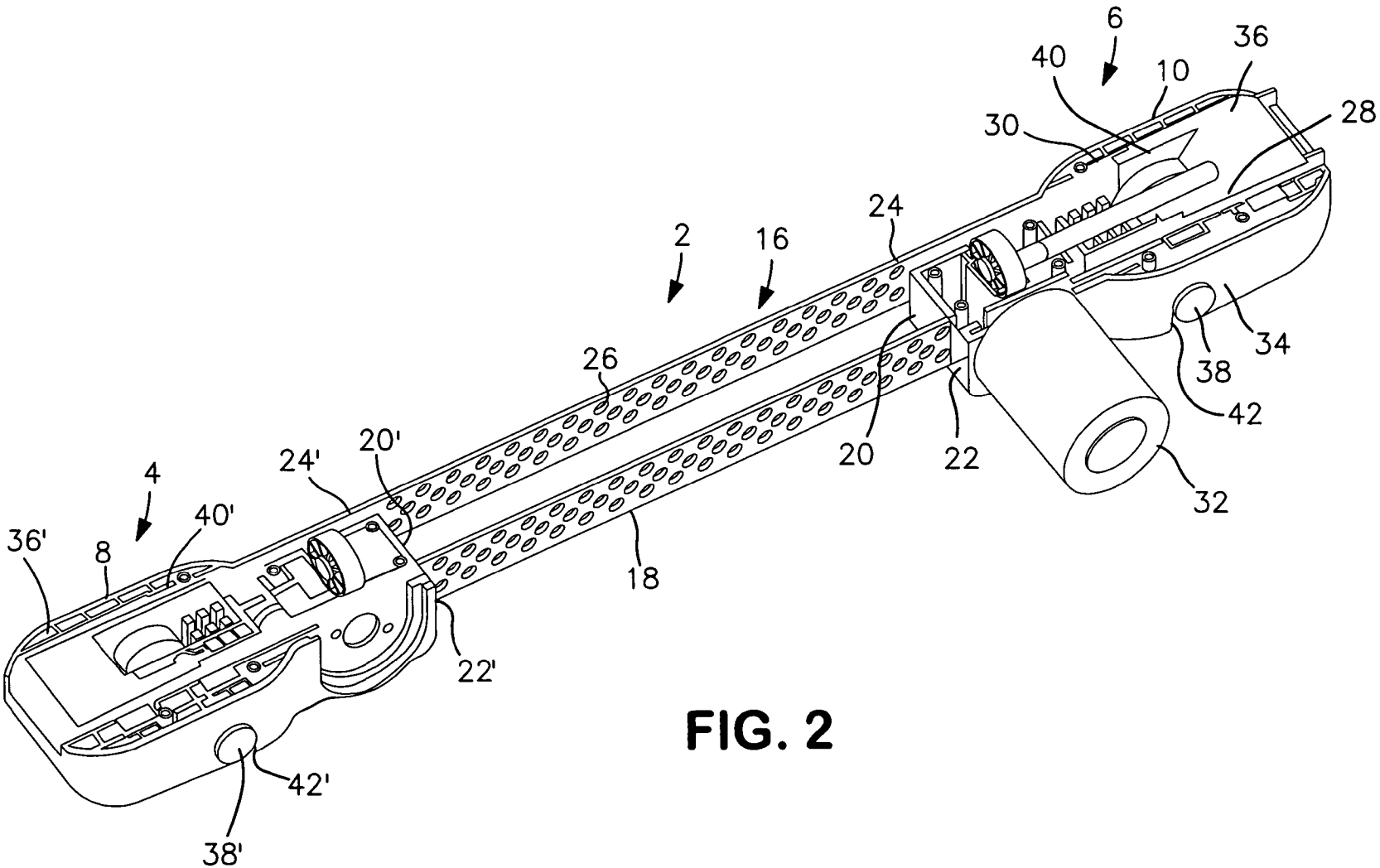
FIG. 2 shows the furniture actuator according to FIG. 1 by way of as chematic perspective representation.

FIG. 2 shows a perspective view of the furniture actuator 2 with the covers 12, 14 of the housings 8, 10 having been removed. In the following, only the structure of actuator unit 6 is explained in detail; the actuator unit 4 is structured mirror-shaped, with the components of the actuator unit 4 having been provided with reference numerals corresponding to the components of actuator unit 6. For reasons of representation, some components of actuator unit 4 have been omitted.

As can be seen from FIG. 2, the housing 10 has two slot-shaped recesses 22, 24 at its front side 20, with the strut 18 extending through the recess 22 and the strut 26 parallel to strut 18 through the recess 24, into the housing 10. The struts 18, 26 are connected in a detachable manner with the housing 10, locking means being provided for locking the struts 18, 26 inside the housing, which locking means are formed by detention or catch means which, in this embodiment, are not represented in detail in the drawing. In order to improve the stability of the furniture actuator 2 and to avoid the occurrence of distortions under load in the operation of the furniture actuator, the struts 18, 26 are mounted within channel-shaped recesses 28, 30 extending from the front wall 20.

The actuator unit 6 has an electric motor 32 which is flange-mounted laterally on the housing 10 of the actuator unit 6 and which, via a gear arrangement presently not explained in detail, connected for being rotatably driven with a rotatably driven adjustment spindle 34 on which a spindle nut 36 is arranged, which is secured against rotation and can be displaced in the axial direction of the adjustment spindle. The spindle nut 36 forms a linearly movable activation element of the actuator unit 6 and serves for pivoting a pivot lever 40 connected secured against rotation with a pivot shaft 38. In this embodiment the pivot shaft 38 including the pivot lever 40 is not a component of the furniture actuator 2, but of a slatted grid which can be adjusted by means of the furniture actuator 2 as will be explained in greater detail below by way of FIG. 3. For mounting the pivot shaft 38, the housing 10 has a basically semicircular-shaped recess 42, into which the pivot shaft 38 has been loosely inserted in the assembly position of the furniture actuator 2. If necessary, the pivot shaft 32 can be secured within the recess 42 by means of a locking element.

If necessary, not only the spindle nut 36 forming the linearly movable actuating element, together with the adjusting spindle 34 and the gearing arrangement of the actuating unit 6 not represented in detail can be received in the housing 10, but additionally also the electric motor 32.

Figure 3:
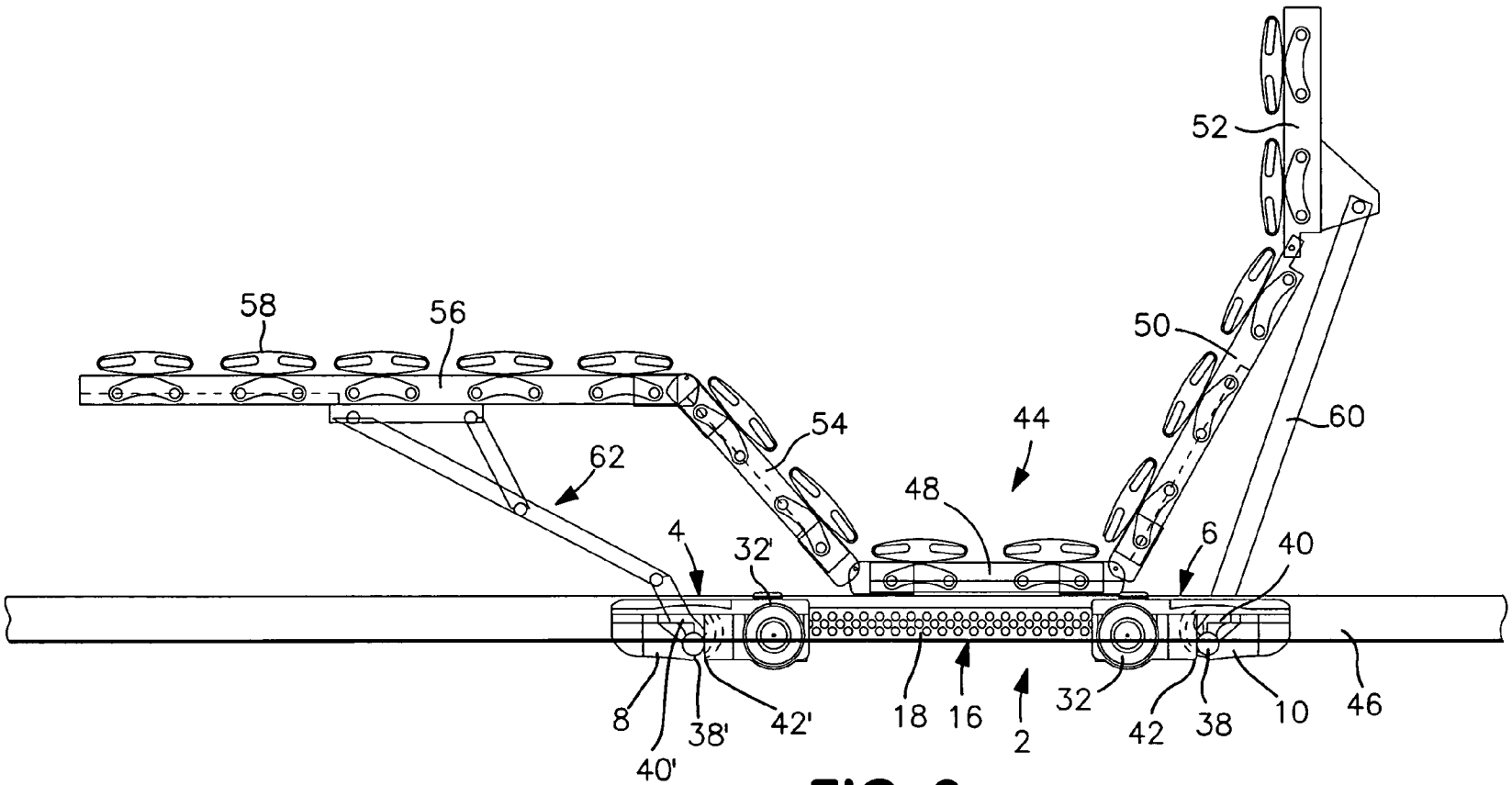
FIG. 3 shows the furniture actuator according to FIG. 1 in its assembly position.

FIG. 3 shows the furniture actuator 2 in the assembly position, the furniture actuator 2, in this example of embodiment, serving to adjust a motor-adjustable support device for the upholstery of a piece of furniture for sitting and/or lying in the shape of a slatted grid 44. The slatted grid 44 has a central supporting portion 48 connected to a frame 46, to the end of which portion an upper body support portion 50 is connected in a articulated manner and pivotable about a horizontal pivot axis. A head supporting portion 52 is connected, in an articulated manner, with the side of the upper body supporting portion 50 opposite the central supporting portion 48 and pivotable about a horizontal pivot axis.

A leg supporting portion 54 is connected in an articulated manner with the side of the central supporting portion 48 opposite the upper body supporting portion, which portion 54 is pivotable about a horizontal axis, a calf supporting portion 56 being connected to the side of the leg supporting portion 54 which is opposite the central supporting portion 48, and being pivotable about a horizontal pivot axis. The supporting portions 48 through 56 have resilient slats at their upper sides, of which FIG. 3 only has one slat referred to by reference numeral 58.

The head supporting portion 52 is connected to the pivot shaft 38 by means of a lever 60, while the calf supporting portion 56 is connected to the pivot shaft 38' via a lever arrangement 62. As can be seen from FIG. 3, the furniture actuator 2 together with the recesses 42, 42' has been mounted on the pivot shafts 38, 38' from the supporting side, i.e., in FIG. 3 from above.

In order to adjust the head supporting portion 52 and the upper body supporting portion 50 the electric motor 32 drives the adjustment spindle 34 such that the spindle nut 36 moves towards the left in FIG. 3 and thereby pivots the pivot lever 40 in FIG. 3 counterclockwise, so that the pivot shaft 38 is rotated. In this case, the pivot shaft 38 pivots the lever 60 whose one end is connected fixed against rotation to the pivot shaft 38, and whose other end is connected in an articulated manner with the head supporting portion 52. In this manner, the head supporting portion 52 together with the upper body supporting portion 50 is adjusted from a start position, in which the supporting portions 50, 52 are essentially in a horizontal position, into the adjusted position represented in FIG. 3. A return positioning of the head supporting portion 52 and the upper body supporting portion 50 to the starting position occurs under the weight load of the supporting portions 50, 52, however with the actuator turned on.

An adjusting of the leg supporting portion 54 and the calf supporting portion 56 by means of the actuator unit 4 occurs in a corresponding manner, the actuating units 4, 6 being addressable for controlling either together or separately from each other.

The furniture actuator 2 according to the invention can be manufactured particularly simply and thus in a manner which is efficient regarding costs due to its simple structure. The final assembly of the furniture actuator 2 occurs in a particularly simple and time-saving manner in that the struts 18, 26 are inserted into the recesses 22, 24 of the housing 10 of the actuator unit 6 or the recesses 22', 24' of the housing 8 of the actuator unit 40, and that the locking means on the housings 10, 8, respectively, are locked. Subsequent thereto, the covers 12, 14 are mounted on the housings 8, 10, respectively.

In order to mount the furniture actuator according to the invention on the slatted grid 44 or another piece of furniture for sitting and/or lying on it is simply necessary to mount the furniture actuator 2 with the recesses 42, 42' onto the pivot axis 38, 38' which are mounted on the frame 46 of the slatted grid 44. Subsequent thereto, locking elements not shown in the drawing can be mounted, if necessary, which elements fix the pivot shaft 38, 38' within the recesses 42, 42'.

In a correspondingly simple manner the furniture actuator 2 according to the invention may, if necessary, be dismounted.

Figure 4:
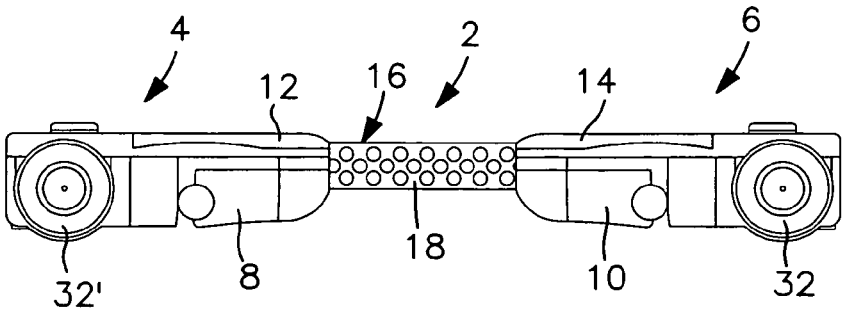
FIG. 4 shows in a similar representation as in FIG. 1 a second embodiment of the furniture actuator according to the invention.

A second example of embodiment of a furniture actuator according to the invention has been represented in FIG. 4, which example differs from the example of embodiment according to FIG. 3 in that the struts 18, 26 of the base body have a smaller length, so that the distance of the recesses 42, 42' in the embodiment example according to FIG. 4 has been reduced with regard to the example of embodiment according to FIG. 1. In this manner, a furniture actuator 2 has been realized by way of identical use of the actuator units 4, 6 merely by using struts 18, 26 having a smaller length, which actuator 2 can be used for adjusting a lath grid in which the pivot shafts 38, 38' have a smaller distance than in the case of the slatted grid 44 according to FIG. 3. In this manner, the series fabrication of different furniture actuators has been essentially simplified, because, in order to adapt to differing distances of the pivot shafts of a slatted grid, merely struts 18, 26 having a smaller length need be provided. These struts 18, 26 can exist, e.g. of metre ware, which is cut down to the respectively required length.

Figure 5:
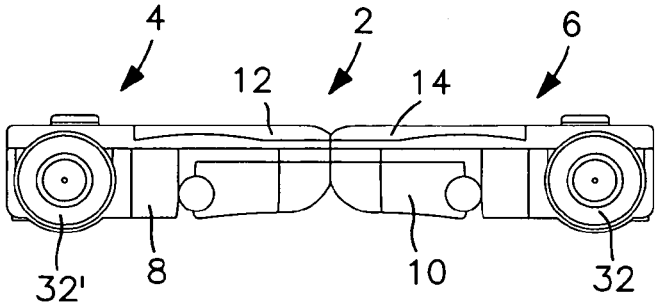
FIG. 5 shows in a similar representation as in FIG. 1 a third embodiment of a furniture actuator according to the invention.

FIG. 5 represents a third example of embodiment of a furniture actuator 2 according to the invention, in which compared to the example of embodiment shown in FIG. 4, the distance of the recesses 42, 42' has been reduced further such that the housings 8, 10 of the actuator units 4, 6 engage each other with their frontal sides.

Figure 6:
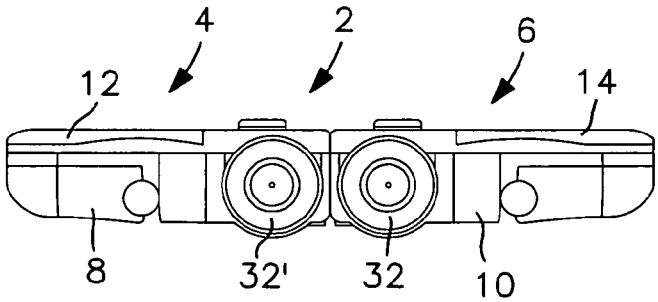
FIG. 6 shows in a similar representation as in FIG. 1 a fourth embodiment of a furniture actuator according to the invention.

A fourth example of embodiment of a furniture actuator according to the invention is represented in FIG. 6, which differs from the embodiment example according to FIG. 5 in that the actuator units 4, 6 lie adjacent to each other with their ends having the electric motors 32, 32'.

Figure 7:
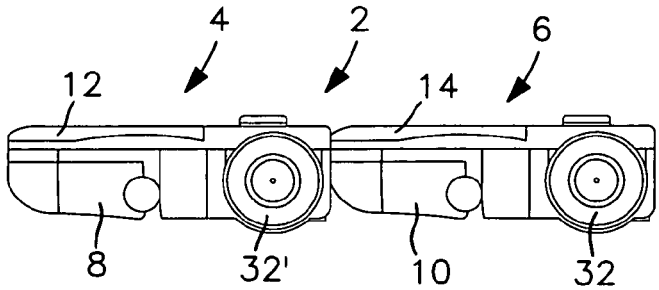
FIG. 7 shows in a similar representation as in FIG. 1 a fifth embodiment of a furniture actuator according to the invention.

A fifth example of embodiment of a furniture actuator according to the invention is represented in FIG. 7, which differs from the example of embodiment according to FIG. 4 in that the end of the actuator unit 4 having the electric motor 32 lies adjacent to the end of the actuator unit 6 opposite the electric motor 32.

Figure 8:
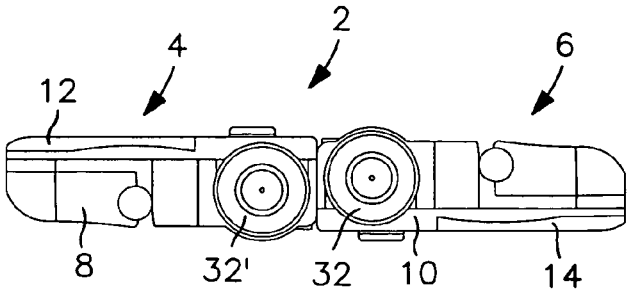
FIG. 8 shows in a similar representation as in FIG. 1 a sixth embodiment of a furniture actuator according to the invention.

A sixth example of embodiment of a furniture actuator according to the invention is represented in FIG. 8, which differs from the exemplified embodiment according to FIG. 4 in that the recess 42' in the housing 8 of the actuator unit 4 faces downwardly while the recess 42 in the housing 10 of the actuator unit 6 faces upwardly.

As can be taken from a comparison of FIGS. 1 through 8, the furniture actuators 2 according to these exemplified embodiments each exist of two actuator units 4, 6 which can be shaped identically, and the base body 16, the individual furniture actuators 2 merely differing by the length of the struts 18, 26 of the base body 16. Thus, the teaching of the invention enables to realize most various furniture actuators 2 in a modular manner by using the same components, in a simple and cost-efficient manner.

Figure 9:
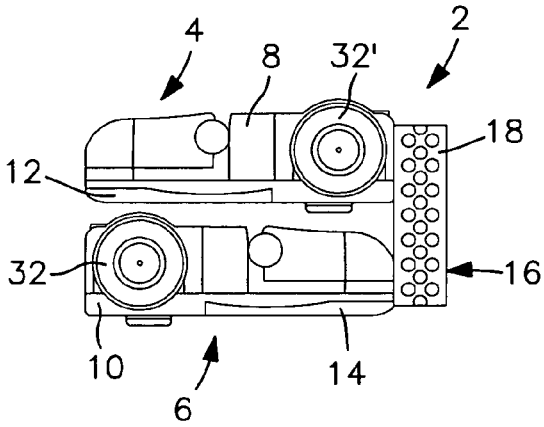
FIG. 9 shows in a similar representation as in FIG. 1 a seventh embodiment of a furniture actuator according to the invention.

A seventh exemplified embodiment of a furniture actuator according to the invention is represented in FIG. 9, which differs from the example of embodiment according to FIG. 1 in that the struts 18, 26 of the base body 16 are not formed in a linear manner, but U-shaped, with the housings 8, 10 of the actuator units being mounted on arms of the strut 18 as well as of the non-shown strut 26, which arms are parallel to each other and not shown in FIG. 9.

Figure 10:
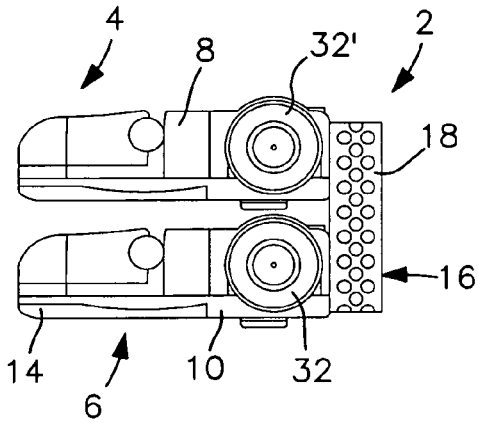
FIG. 10 shows in a similar representation as in FIG. 1 an eighth embodiment of a furniture actuator according to the invention.

An eighth exemplified embodiment of a furniture actuator according to the invention is represented in FIG. 10 which differs from the exemplified embodiment of FIG. 9 in that the actuator units 4, 6 are mounted on the strut 18 as well as on the non-shown strut 26, such that the electric motors 32', 32 lie immediately above each other.

Figure 11:
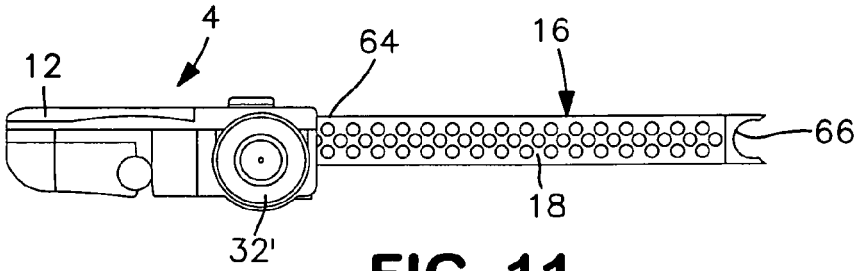
FIG. 11 shows in a similar representation as in FIG. 1 a ninth embodiment of a furniture actuator according to the invention.

A ninth example of embodiment of a furniture actuator according to the invention is shown in FIG. 11, which is formed as a single actuator and has a single actuator unit 4 whose housing is connected to one end 64 of the base body 16. The end of the base body 16 opposite the actuator unit 4 is formed as a fork 66 in this embodiment, by which fork the furniture actuator 2 is supported on one portion of the piece of furniture in the assembly position. In this exemplified embodiment the base body 16 exists of the strut 18 as well as of the further strut 26 which cannot be taken from the drawing.

As becomes apparent from a comparison of FIGS. 1 and 11, the exemplified embodiment according to FIG. 11 is essentially comprised by the same components as the exemplified embodiment according to FIG. 1, with merely one actuator unit 4 being provided. The teaching according to the invention thus enables not only to realize double or twin actuators, but also individual actuators with the same components.

Figure 12:
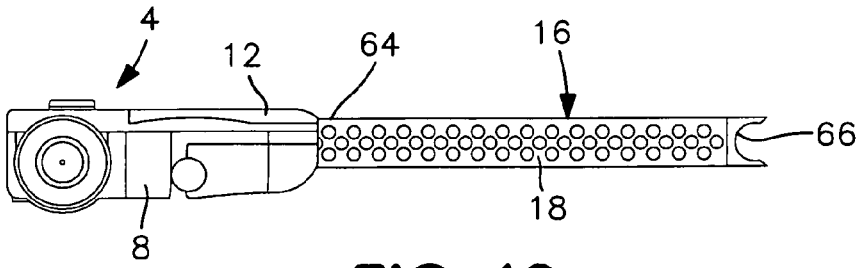
FIG. 12 shows in a similar representation as in FIG. 1 a tenth embodiment of a furniture actuator according to the invention.

A tenth exemplified embodiment of a furniture actuator according to the invention is represented in FIG. 12, which differs from the embodiment according to FIG. 11 in that the orientation of the actuator unit 4 is chosen such that the electric motor 32' is arranged on the free end of the furniture generator 2 opposite the fork 66.

The invention claimed is:

1. An electromotive furniture actuator for adjusting portions of a piece of furniture relative to each other, comprising a first actuator unit for adjusting a first portion of the piece of furniture, said first actuator unit including a first housing containing a first attachment means for a first end of an elongated base body, a second actuator unit for adjusting a second portion of the piece of furniture, said second actuator unit including a second housing containing a second attachment means for a second end of an elongated base body, and an elongated base body extending between said first and second actuator units, a first end of said elongated base body being directly attached to said first attachment means and an opposite second end of said elongated base body being directly attached to said second attachment means.

2. The furniture actuator according to claim 1, wherein said first and second attachment means respectively comprise first and second locking means.

3. The furniture actuator according to claim 2, wherein the first and second locking means respectively comprise first and second catch means.

4. The furniture actuator according to claim 1, wherein the elongated base body extends linearly.

5. The furniture actuator according to claim 1, wherein the base body is formed as an angle or is U-shaped.

6. The furniture actuator according to claim 1, wherein the base body is essentially rigid.

7. The furniture actuator according to claim 1, wherein the base body comprises at least two parts which are adjustable relative to each other and which can be locked in a respective position of adjustment.

8. The furniture actuator according to claim 1, wherein the elongated base body consists of first and second parallel struts.

9. The furniture actuator according to claim 1, wherein said first and second housings each has at least one recess through which the base body extends.

10. The furniture actuator according to claim 1, wherein at least one of said first and second actuator units includes a movable activation element for pivoting a pivot lever functionally connected to the portion of the piece of furniture to be adjusted in the assembly position of the furniture actuator.

11. The furniture actuator according to claim 10, wherein the activating element is linearly movable is driveably connected to a linearly movable actuating element, or is formed by the actuating element.

12. The furniture actuator according to claim 11, wherein the linearly movable actuating element is a screw nut supported secured against distortion and movable in the axial direction on an adjustment spindle which can be driven for rotation.

13. The furniture actuator according to claim 11, wherein the linearly movable actuating element is an adjustment spindle movable in its axial direction and mounted secured against distortion, on which adjustment spindle a spindle nut which is stationary and driven for rotation is arranged.

14. The furniture actuator according to claim 1, wherein at least one of said first and second housings has a recess in which, in the assembly position of the furniture actuator, a shaft carrying a pivot lever of the piece of furniture engages such that the pivot lever is in functional connection with the linearly moveable activating element.

15. An electromotive furniture drive for adjusting a portion of a piece of furniture comprising a housing, an electric motor, a gear arrangement, a rotatable spindle driven by the motor through the gear arrangement, a spindle nut forming an activation element arranged on the spindle and secured against rotation in the housing and which can be displaced in an axial direction of the rotatable spindle when driven by the motor, a recess in the housing for receiving a pivot shaft with a pivot lever when mounted in a piece of furniture such that the pivot lever is located internally in the housing and such that the spindle nut can abut the pivot lever in a lose manner, and wherein the housing at an end is designed for receiving attachment means.

16. The electromotive furniture drive according to claim 15, including the attachment means attached to said end of said housing.

17. The electromotive furniture drive according to claim 16, wherein said attachment means comprises an elongated body.

18. The electromotive furniture drive according to claim 17, wherein said elongated body comprises two parallel struts.

* * * * *